US011643921B2

(12) United States Patent
Mannai et al.

(10) Patent No.: US 11,643,921 B2
(45) Date of Patent: May 9, 2023

(54) ROD PUMP SYSTEM DIAGNOSTICS AND ANALYSIS

(71) Applicants: SCHLUMBERGER TECHNOLOGY CORPORATION, Sugar Land, TX (US); MASSACHUSETTS INSTITUTE OF TECHNOLOGY, Cambridge, MA (US)

(72) Inventors: Sebastien Mannai, Cambridge, MA (US); Tianxiang Su, Somerville, MA (US); Sepand Ossia, Arlington, MA (US); Choon Sooi Tan, Andover, MA (US)

(73) Assignees: SCHLUMBERGER TECHNOLOGY CORPORATION, Sugar Land, TX (US); MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 0 days.

(21) Appl. No.: 17/052,297

(22) PCT Filed: May 2, 2019

(86) PCT No.: PCT/US2019/030315
§ 371 (c)(1),
(2) Date: Nov. 2, 2020

(87) PCT Pub. No.: WO2019/213343
PCT Pub. Date: Nov. 7, 2019

(65) Prior Publication Data

US 2021/0164337 A1 Jun. 3, 2021

Related U.S. Application Data

(60) Provisional application No. 62/665,896, filed on May 2, 2018.

(51) Int. Cl.
*E21B 47/009* (2012.01)
*E21B 47/06* (2012.01)
(Continued)

(52) U.S. Cl.
CPC ..... *E21B 47/009* (2020.05); *E21B 47/06* (2013.01); *E21B 47/18* (2013.01); *E21B 43/127* (2013.01)

(58) Field of Classification Search
CPC ..... E21B 47/009; E21B 47/008; E21B 47/06; E21B 47/18; E21B 47/20; E21B 43/127; E21B 43/126; E21B 43/12
See application file for complete search history.

(56) References Cited

U.S. PATENT DOCUMENTS 3,343,409 A * 9/1967 Gibbs ..... F04B 49/02 73/152.61
4,509,901 A 4/1985 McTamaney et al.
(Continued)

FOREIGN PATENT DOCUMENTS

EP 0535729 A2 4/1993

OTHER PUBLICATIONS

Search Report and Written Opinion of International Patent Application No. PCT/US2019/030315 dated Aug. 23, 2019; 12 pages.

*Primary Examiner* — Caroline N Butcher
(74) *Attorney, Agent, or Firm* — Ashley E. Brown

(57) ABSTRACT

Providing diagnostics or monitoring operation of a rod pressure includes using waves in production fluid produced by the rod pump may be used to determine one or more operating states of the rod pump. The one or more operating states of the rod pump may be used by a user to diagnose or monitor the operation of the rod pump.

28 Claims, 8 Drawing Sheets

(51) Int. Cl.
*E21B 47/18* (2012.01)
*E21B 43/12* (2006.01)

(56) References Cited

U.S. PATENT DOCUMENTS

| | | | | |
|---|---|---|---|---|
| 5,230,607 | A * | 7/1993 | Mann | E21B 47/009 417/18 |
| 7,669,651 | B1 * | 3/2010 | Carstensen | E21B 47/009 417/63 |
| 9,574,442 | B1 | 2/2017 | McCoy | |
| 2002/0084071 | A1 | 7/2002 | McCoy et al. | |
| 2015/0090445 | A1 | 4/2015 | Miller et al. | |
| 2016/0102542 | A1 * | 4/2016 | DaCunha | E21B 43/127 702/6 |

* cited by examiner

ROD PUMP SYSTEM DIAGNOSTICS AND ANALYSIS

RELATED APPLICATIONS

This application claims priority to, and incorporates herein by reference in its entirety, U.S. Provisional Patent Application No. 62/665,896, which was filed on May 2, 2018.

TECHNICAL AREA

Disclosed embodiments are related to diagnosing rod pumps.

BACKGROUND

Rod pump systems are the most commonly used artificial lift method for lifting production fluid from reservoirs that can no longer flow naturally. Conventionally, rod pumps use a reciprocating rod attached to a plunger to lift production fluid out of a well. These rod pumps traditionally utilize a valve system that allows the production fluid to be moved from the base of the well to the surface. The reciprocating motion of the rod is generally generated by a motor positioned on the surface and is operatively coupled to the rod by a walking beam which converts the rotary motion of the motor into reciprocating motion of the rod.

Generally, rod pumps are controlled by a duty cycle which turns the motor on and off to avoid over-pumping of the well. In some cases, this duty cycle may be controlled by an operator, with the operator selectively turning the rod pump on or off. In other cases, the duty cycle may be controlled by a timer with off and on periods predetermined by the operator such that the rod pumps may operate semi-autonomously. In yet another instance, the motor may be a variable speed motor that may be operated continuously at different speeds to limit downtime while avoiding over-pumping of the well.

SUMMARY

A method of diagnosing or monitoring operation of a rod pump includes sensing pressure waves generated from movement of a pump plunger of the rod pump and detecting one or more operating states of the rod pump based at least partly on the sensed pressure waves.

A system for diagnosing or monitoring a rod pump includes at least one pressure sensor constructed and arranged to sense pressure waves generated from movement of a pump plunger of the rod pump. The at least one pressure sensor interfaces to a processor that is constructed and arranged to automatically detect one or more operating states of the rod pump based at least partly on the sensed pressure waves.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
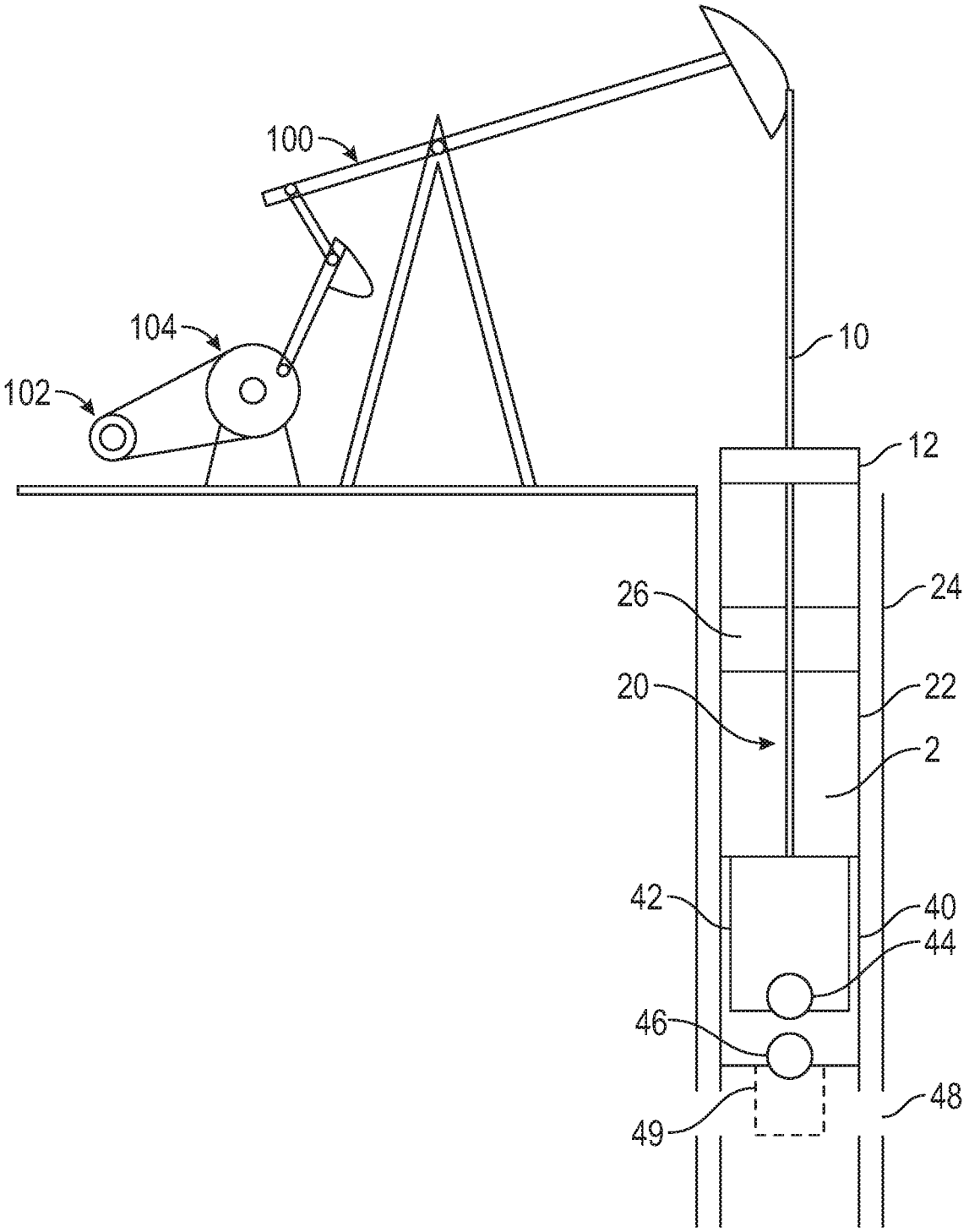
FIG. 1 (Prior Art)
FIG. 1 is a schematic view of a conventional rod pump system.

The following detailed description is meant to aid the understanding of one skilled in the art with regard to various combinations of embodied features, and is not meant in any way to unduly limit the scope of any present or future related claims relating to this application.

In order to better inform the operation of a motor in a rod pump system, some conventional rod pump systems include sensor systems to gather information about one or more states of the rod pump system. Some of these conventional systems utilize a load cell in the rod pump system which measures the tensile load in the rod pump. Some other conventional systems use a shockwave-based system which measures fluid height in a casing surrounding the rod and production fluid tubing. Some other conventional systems may measure motor current, voltage, and/or instant RPM to evaluate the torque generated by the motor. The rod pump geometry and the motor torque may then be used to evaluate the surface rod tensile load. In traditional vertical wells, these sensor systems entail expensive or difficult installation procedures. The load cells installed in rod pumps often need to withstand high repetitive loads and are accordingly expensive to install on a wide variety of installations. Additionally, the load cells are often installed between the rod and the walking beam, increasing the mechanical points of failure for the rod pump system. The shockwave-based systems that measure fluid height in the casing are similarly expensive and difficult to install. Additionally, the shockwave-based systems may not be operated continuously as they require a source of high pressure gas. Furthermore, the effectiveness of shockwave-based systems may be limited in deeper wells due to shock wave attenuation. In addition to the above, horizontally drilled wells have become more commonly implemented, with the rod curving to follow the deviation of the well. In these cases, frictional forces along the length of the curved rod can induce noise that makes it difficult to identify the state of the rod pump. Furthermore, the dynamics of the bent rod is complex (as it can involve both friction and rod bending), which also makes it difficult to identify the state of the rod pump.

In view of the above, the inventors have recognized the numerous benefits of an acoustic sensor system that measures acoustic waves in the production fluid to provide accurate diagnostics for rod pumps while being less expensive and simpler to install relative to conventional sensor systems.

According to one embodiment of the present disclosure, a method of diagnosing or monitoring the operation of a rod pump includes sensing pressure waves generated from movement of a pump plunger of the rod pump, determining one or more operating states of the rod pump based at least partly on the sensed pressure waves. For example, the rod pump may include a pressure sensor constructed and arranged to measure the pressure of the production fluid at a predetermined location. By measuring the pressure at this location over time, the pressure sensor may measure one or more properties of acoustic waves (i.e., pressure waves) that correspond to a particular operating state of the rod pump. As the acoustic waves are monitored over time, the pressure sensor may observe a change to the acoustic wave, including but not limited to an amplitude change, phase change, and/or mean pressure change (i.e., change in average pressure over any given time period greater than or equal to a single pump cycle). The changes to the acoustic wave may indicate a particular type of and/or a change in one or more operating states of the rod pump. For example, if the pressure sensor observes a phase change in an acoustic wave, this may indicate an over-pumping state for the rod pump system. In some embodiments, a model of the rod pump system may be employed such that any pressure waves in the production fluid sensed by a pressure sensor may be used to determine one or more operating states of the rod pump.

In some embodiments, particular shapes, magnitudes, phases, and/or changes in these features of sensed pressure waves in production fluid may correspond to a particular operating state of a rod pump system. For example, the operating state may be at least one of normal pump operation, gas lock (i.e., gas compression), pump tagging, unanchored tubing, distorted barrel, valve leakage, flumping, barrel leakage, barrel contact friction, fluid pounding, and gas interference. In normal pump operation, the rod pump system is running at a normal speed (i.e., design speed) with no significant problems that may require the speed to be modified or any general maintenance on the pump system. Gas lock occurs when the production fluid is at a low enough level such that the reciprocating motion of the rod compresses the gas and moves no fluid. Pump tagging occurs when a plunger of the rod pump system hits the bottom of the rod pump, which increases mechanical wear and can cause breakage of rod pump system components. Unanchored tubing occurs when the tubing becomes detached from the wellbore or the casing, and it can accordingly cause mechanical wear or other problems along the length of the rod. A distorted barrel occurs when a barrel containing the plunger becomes warped such that it induces friction and wear on the plunger or causes a leakage of production fluid. Valve leakage occurs when the valves of the rod pump system do not seal properly which leads to production fluid leakage and inefficient pumping. Flumping occurs when production fluid moves up a casing external to the tubing carrying the production fluid, which in some cases can lead to gas lock. Barrel leakage occurs when a hole in the barrel causes the production fluid to leak back into the well. Barrel contact friction occurs when the barrel is undersized for the plunger and causes additional friction that may lead to mechanical wear. Fluid pounding can occur when the pumping rate of the rod pump exceeds the production rate of the formation. It can also be due to the accumulation of low-pressure gas between the valves of the rod pump. On the downstroke of the rod pump, the gas is compressed, but the pressure inside the barrel does not open the traveling valve until the traveling valve strikes the liquid. Finally, when the traveling valve opens, the weight on the rod string can suddenly drop thousands of pounds in a fraction of a second. This condition should be avoided because it causes extreme stresses, which can result in premature equipment failure. Gas interference can occur when gas enters the rod pump system. After the downstroke begins, the compressed gas reaches the pressure needed to open the traveling valve of before the traveling valve reaches liquid. The traveling valve opens slowly, without the drastic load change experienced in fluid pound. It does not cause premature equipment failure but can indicate poor pump efficiency.

In some embodiments, pressure waves in production fluid may be measured to determine at least one operating state of a rod pump system, thereby providing diagnostics for the rod pump system or improving maintenance. The pressure waves measured in the production fluid may be fit to one or more models of the rod pump system which incorporates various characteristics of the different rod pump system components. Depending on a particular operational mode of the rod pump system, different information can be obtained through pressure wave measurement. For example, when the rod pump system is stopped (i.e., the motor speed is approximately zero) plunger leakage rate or valve leakage rate can be measured, thus providing valuable information on the wear state of the rod pump system to an operator. Additionally, information regarding at least one operating state of the rod pump system (e.g., plunger leakage rate, valve leakage rate, etc.) may be obtained when the rod pump system is operating (i.e., pumping) using a model of the rod pump system and the sensed pressure waves. When the rod pump system is pumping (i.e., the motor speed is non-zero), the plunger movement may be reconstructed using a model of the rod pump and the measured pressure waves to provide diagnostics for the rod pump system. For example, the pressure waves and model may be used to determine the period during which either a travelling valve or standing valve is open or closed during each stroke. Similarly, the pressure waves and model may be used to determine the amount of gas (i.e., gas fraction) entering production tubing through a plunger as a particular gas fraction may correspond to a particular acoustic signature when characteristics of the rod pump system components are accounted for. More specifically, there may be a correlation between the phase of a production fluid pressure peak and the gas fraction which can be measured at any location along the production fluid. As yet another example, gas lock may be indicated by the travelling valve failing to open due to insufficient barrel pressure, which may correspond to a particular amplitude, phase shift, or mean pressure of the pressure waves in the production flow. As yet another example, the pressure waves may be periodic, and therefore suitable to measure the stroke frequency of the rod pump system. Of course, any suitable operating state may be determined from the pressure waves in the production fluid, including but not limited to pump tagging or unanchored tubing. In some embodiments, general states of the well may be discerned from the pressure waves in the production fluid. For example, inflow from a reservoir of the well may be calculated using the pressure waves in the production fluid as that inflow is directly linked to the gas fraction. Of course, any combination of pressure waves or singular pressure wave in the production fluid may be used to determine at least one operating state of a rod pump system and/or well, thereby providing diagnostics for the rod pump system.

In some embodiments, a rod pump system extracts production fluid which functions as a wave medium which allows pressure waves to propagate from various components across the system. The production fluid may be disposed in production tubing which follows the shape of a wellbore and casing. The production tubing contains the production fluid, which forms a continuous fluidic column from the downhole pump to an outlet near the surface. Accordingly, pressure waves generated at any location along the fluidic column of production fluid may propagate throughout the fluidic column and may be measured by a pressure sensor positioned at a predetermined location in fluidic communication with the production fluid.

In some embodiments, at least one property of the production fluid may be measured and/or used to improve analysis of the pressure waves in the production fluid. For example, the rod pump system moves the production fluid from the downhole pump towards the outlet, such that the production fluid can be accessed at the surface. As the production fluid flows (i.e., is lifted by the rod pump system or more rarely is naturally flowing due to a large downhole pressure), the production fluid exerts a shear force on the downhole rod. According to this example, a mechanical property of the production fluid, such as shear viscosity, may affect force on the rods and therefore the pressure waves in the production fluid. As another example, the speed of sound in the production fluid may affect the propagation of pressure waves. Thus, incorporating one or more properties of the production fluid may improve diagnostics of the rod system pump. Other properties of the production fluid may include, but are not limited to, density, viscosity, temperature, specific volume, specific weight, specific gravity, and chemical composition. Of course, any suitable property of the production fluid may be measured or used to improve analysis of any acoustic waves propagating throughout the production fluid.

In some embodiments, a rod pump system includes a downhole pump constructed and arranged to lift production fluid from a wellbore. In some embodiments, the downhole pump includes a plunger that reciprocates inside a barrel. The downhole pump also includes two valves: a travelling valve disposed on the plunger and a standing valve disposed on the barrel. Each of the valves can function as a one-way valve that allows production fluid to be moved into production tubing connected to the barrel, such that over time the production fluid will be moved up the production tubing toward the surface. In some embodiments, the traveling valve and standing valve can be configured as ball valves. In this embodiment, the traveling valve may be configured to open on a downstroke of the downhole pump such that production fluid is moved from the barrel into the production tubing. On the upstroke the traveling valve may close while the standing valve opens to allow production fluid from the casing or well bore into the barrel. Thus, production fluid is moved by the downhole pump toward the surface. Without wishing to be bound by theory, displacement of the downhole pump may indicate an operating state of the rod pump system. For example, the downhole pump displacement may indicate whether the plunger extracts a full load of production fluid, or whether the barrel is partly filled with gas (e.g., gas lock or fluid pound). In some cases, the amount of gas in the barrel correlates with a velocity of the plunger downstroke. That is, an operating state such as gas lock or fluid pound may be indicated by a particular velocity or change in velocity of the plunger downstroke. In some embodiments, pressure waves in the production fluid may be used to measure the displacement and velocity of the downhole pump plunger. That is, the pump movement may be inferred by analyzing the pressure signal of the production fluid at or near the surface of the well. In embodiments, time-varying flow parameters of the production fluid (such as fluid velocity) can be measured by one or more additional sensors, and such measured flow parameters can be used to diagnose the operation of the rod pump system.

In some embodiments, a rod pump system may extract production fluid from a reservoir of production fluid disposed in the earth adjacent a wellbore. The rod pump system may include a casing with a series of perforations along the end of the casing adjacent the reservoir. Pressure from the surrounding earth may force production fluid from the reservoir into a cavity between the casing and production tubing of the rod pump system. In some embodiments, one or more characteristics of the reservoir may be employed to improve diagnostics of the rod pump system. For example, diagnostics of the rod pump system may include information on fluid pressure, fluid velocity, reservoir pressure, fluid composition, or multiphase flow. Of course, any suitable combination of characteristic may be employed to provide diagnostics of the rod pump system, as the present disclosure is not so limited.

FIG. 1 depicts a schematic view of a conventional rod pump system which includes surface equipment composed of a pumping unit 100, motor 102, and gear box 104. The pumping unit 100 and gear box 104 are constructed and arranged as a walking beam type pumpjack to create a reciprocating motion from the rotational motion of the motor 102. According to this embodiment, the motor speed rotational speed (e.g., radians per second, revolutions per minute, etc.) directly corresponds to a particular reciprocal velocity of the downhole pump and therefore also corresponds to the production fluid extraction rate. The surface equipment further includes a polished rod 10 and a stuffing box 12. The polished rod 10 is linked to the pumping unit 100 and is arranged to linearly reciprocate through the stuffing box 12. The stuffing box 12 is arranged to create a seal around the polished rod 10 while it linearly reciprocates, such that no or minimal fluid is able to escape around the polished rod 10. In other embodiments, other drive mechanisms such as the long stroke Rotoflex® system (sold commercially by Weatherford) or other drive systems can be used to drive the reciprocating motion of the rod 10.

Below the surface are the well and the downhole components of the rod pump system. The well includes a wellbore 24 which is generally lined with a casing to maintain an even diameter of the well. Inside of the wellbore is production tubing 22, which follows the shape of the wellbore. The production tubing 22 is constructed and arranged to carry production fluid 2 to the surface and is capped by the stuffing box 12. The wellbore 24 may be a vertical well as shown but is not limited thereto. For example, the wellbore or portions thereof can be vertical, deviated, horizontal and can have any selected path that traverses through the formation. Disposed inside of the production tubing 22 are one or more downhole rods 20 linked to each other and to the polished rod 10 at the surface. The one or more downhole rods are constructed and arranged to transfer the reciprocating motion of the polished rod 10 down the length of the wellbore 24. The one or more downhole rods 20 are held centrally within the production tubing by one or more rod guides 26. The rod guides 26 are constructed and arranged to prevent the one or more downhole rods 20 from contacting the production tubing 22 and may also serve as joints between the one or more downhole rods 20.

As shown in FIG. 1, the rod pump system may also include a downhole pump. The downhole pump includes a barrel 40 and a plunger 42. The plunger 42 is constructed and arranged to reciprocate within the barrel 40 and is driven by the one or more downhole rods 20 linked to the polished rod 10. The plunger 44 also includes a traveling valve 44 and the barrel 40 includes a standing valve 46. The traveling valve 44 and standing valve 47 are configured as one-way valves and cooperate to move production fluid 2 up the production tubing 22 as the plunger 44 reciprocates (for example, see FIGS. 2-3). In this embodiment, the downhole pump further includes a separator 49 disposed on the barrel 40 to partially filter particulates out of the production fluid. The downhole pump moves reservoir fluid produced from a reservoir which flows through one or more openings 48 in the casing 24 adjacent the downhole pump. Without wishing to be bound by theory, a combination of gravity and pressure moves reservoir fluid from the reservoir to the inside of the casing such that the production fluid may be extracted by the downhole pump.

In some embodiments, motion between the polished rod 10 and the downhole pump may be converted by operation of the one or more downhole rods 20 and the one or more rod guides 26. For example, if the downhole rods 20 are not rigid, the linear force from the polished rod 10 may cause deformation of downhole rods 20, resulting in axial waves propagating along the rods 20. As another example, if the wellbore 24 is substantially non-vertical (i.e. curved, horizontal, etc.), the motion may be converted in directions conforming to the direction of the wellbore 24. That is, as the one or more downhole rods 20 follow the trajectory of the wellbore 24, force from the polished rod 10 may be converted in the direction of the wellbore 24. Accordingly, as the motion from the polished rod 10 is converted by the one or more downhole rods 20, the one or more rod guides 26 may be placed along the downhole rods 20 to prevent direct contact of the downhole rods 20 with the wellbore/casing and allow the downhole rods 20 to reliably transfer motion to the downhole pump.

Figure 2:
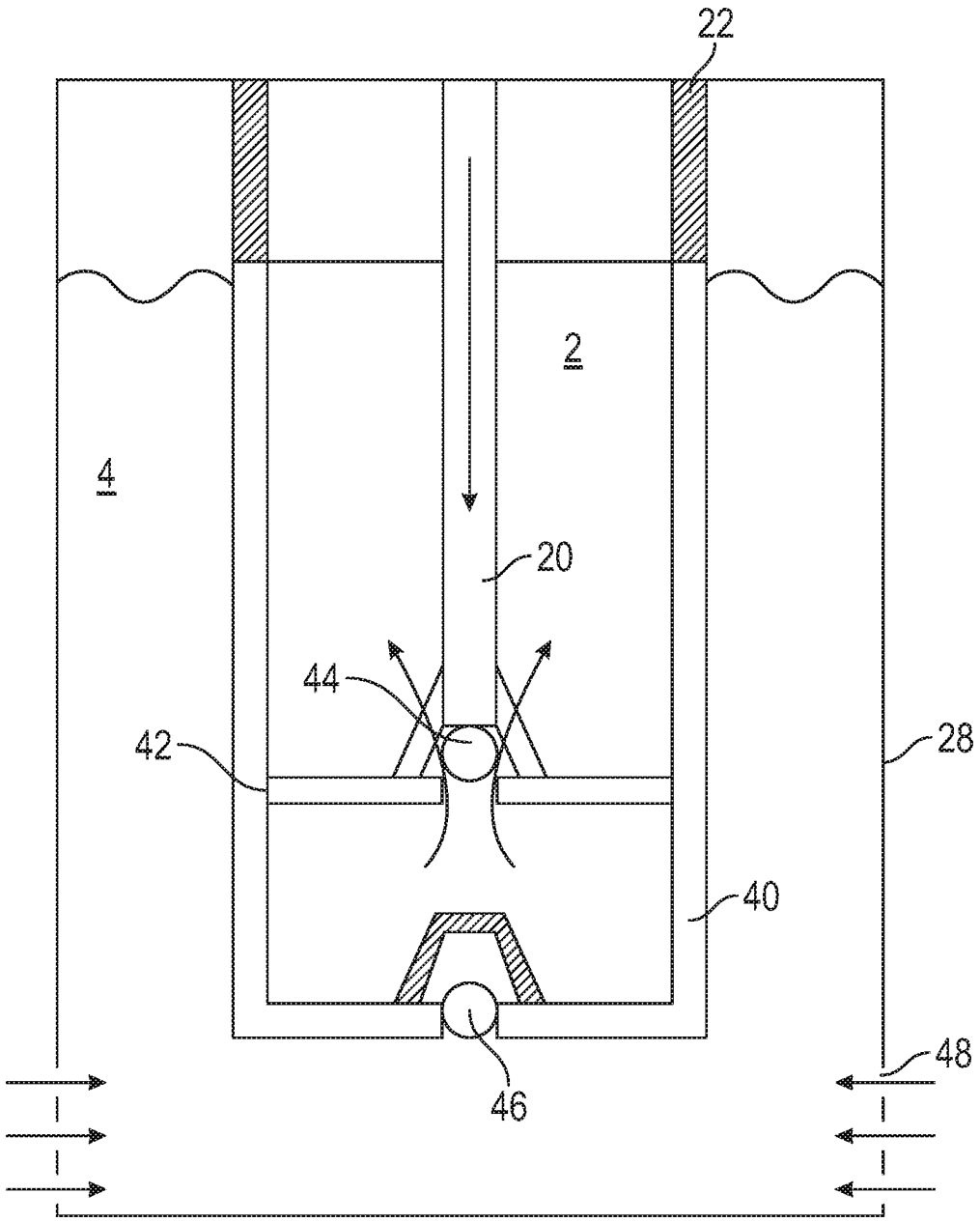
FIG. 2 is a cross sectional view of one embodiment of a downhole pump during a down stroke of the rod pump system.

FIG. 2 is a cross sectional view of one embodiment of a downhole pump during a down stroke of the rod pump system. The downhole pump is disposed at the bottom of production tubing 22 which carries production fluid 2 to the surface. The downhole pump includes a barrel 40 and a plunger 42. The plunger 42 is arranged to reciprocate inside of the barrel and is driven by one or more downhole rods 20. The plunger 42 includes a traveling valve 44, and the barrel 40 includes a standing valve 46. The valves 44, 46 can each be configured as a ball valve in this embodiment. Reservoir fluid 4 is produced from a combination of gravity and pressure and flows through one or more openings 48 in the casing 28 into space between the casing 28 and the production tubing 22 and barrel 40 as shown. In this configuration, the production tubing 22 and the barrel 40 separates the production fluid 2 from the reservoir fluid 4. During the downstroke, the plunger 42 is forced downward into the barrel 40 by the one or more downhole rods 20. During the downward movement, fluid pressure forces the traveling valve 44 into an open configuration (e.g., where the ball does not seal the opening leading from the bottom portion of the barrel to the top portion of the barrel) and production fluid 2 that has been loaded into the bottom portion of the barrel 40 during the last upstroke (FIG. 3) flows upward into the production tubing 22. The same fluid pressure forces the standing valve 46 into its closed configuration (e.g., where the ball seals the opening leading into the bottom portion of the barrel 40 from the space between the casing 28 and the production tubing 22 and barrel 40 that holds the reservoir fluid 4) such that the production fluid within the bottom portion of the barrel 40 is not able to escape back to the space between the casing 28 and the production tubing 22 and barrel 40. In the down stroke of the rod pump system, the plunger 42 can be forced near the base of the barrel (i.e., the bottom of the stroke), such that the production fluid 2 in the barrel 40 is moved into the production tubing 22 and production fluid 2 in the production tubing 22 moves upward toward the surface. Note that the rod pump system of FIG. 2 can utilize additional features, such as a gas separator or other element, which are not shown for simplicity of description.

Figure 3:
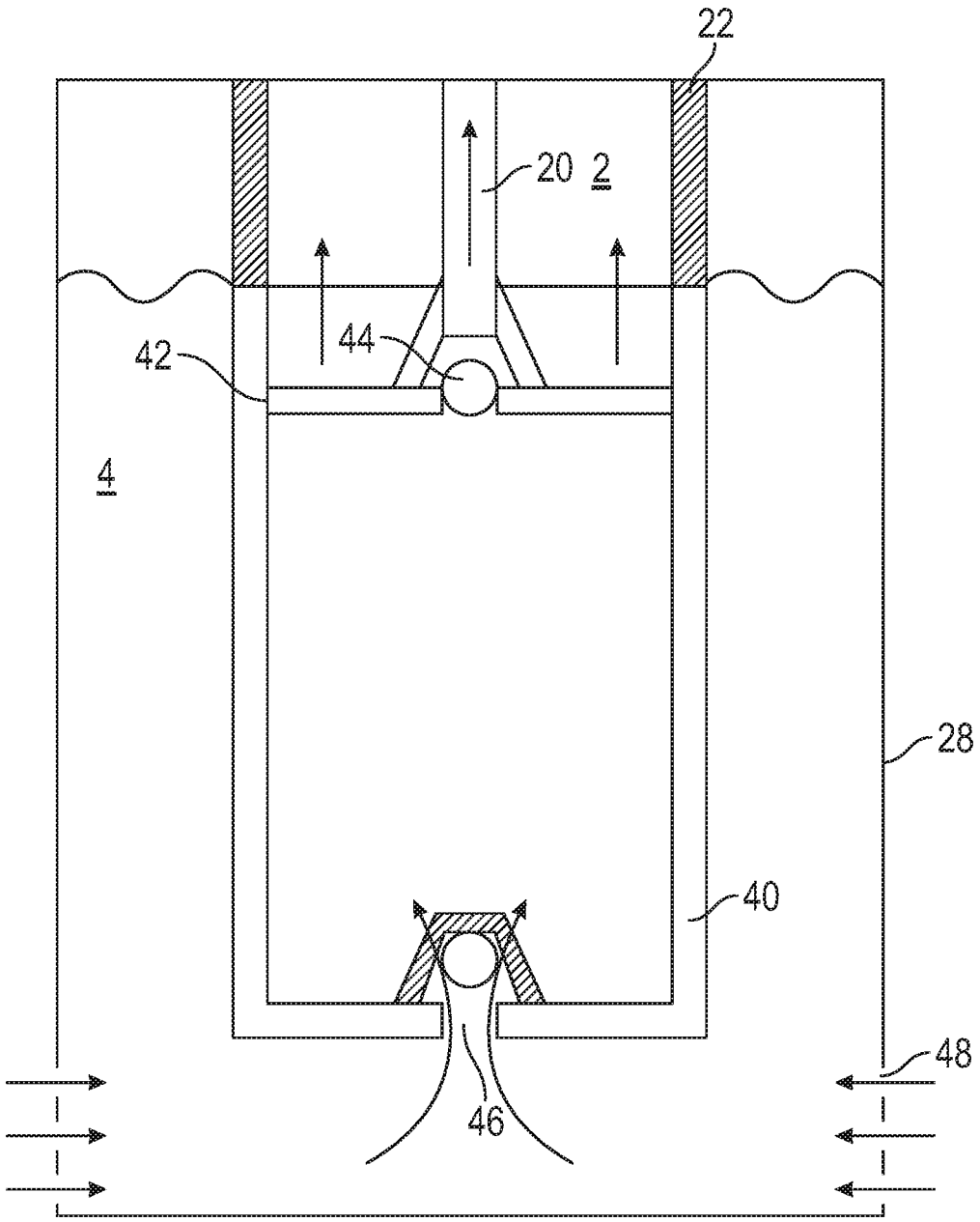
FIG. 3 is a cross sectional view of one embodiment of a downhole pump during an upstroke of the rod pump system.

FIG. 3 is a cross sectional view of the embodiment of the downhole pump of FIG. 2 during an upstroke of the rod pump system, which occurs after the plunger 42 has reached the bottom of the stroke and its movement reverses upward along the barrel 40. As the plunger 42 begins to move upward, it lifts the production fluid 2 disposed in the production tubing 22. Accordingly, pressure in the production fluid 2 is increased, and that increase in pressure forces the traveling valve 44 into a closed configuration (e.g., where the ball seals the opening leading from the bottom portion of the barrel to the top portion of the barrel) in order to limit leakage of the production fluid back into the bottom portion of the barrel 40. As the plunger 42 lifts upwards, negative pressure is created inside of the bottom portion of the barrel 40. In response to such negative pressure, the standing valve 46 is forced into an open configuration (e.g., where the ball does not seal the opening leading into the bottom portion of the barrel 40 from the space between the casing 28 and the production tubing 22 and barrel 40 that holds the reservoir fluid 4) which allows the reservoir fluid 4 to move through the standing valve 46 to fill the bottom portion of the barrel 40 as production fluid 2. As the reservoir fluid 4 moves through the standing valve 46 to refill the bottom portion of the barrel 40, additional reservoir fluid 4 enters the space between the casing 28 and the production tubing 22 and barrel 40 through the one or more openings 48 in the casing 28. In this manner, the reciprocal cycle of translation of the plunger 42 in the barrel 40 progressively moves production fluid 2 up the production tubing 22 toward the surface.

Without wishing to be bound by theory, the gas fraction may be determined by the reservoir fluid level. For example, in cases where the reservoir fluid level is consistently above the level of the standing valve, there may be approximately zero gas fraction. That is, there is enough reservoir fluid to replace the entire volume of the barrel during each stroke, such that no gas is introduced to the barrel. In other cases where the reservoir fluid level drops to a level approximately equal to or below the standing valve, gas from the cavity between the casing and production fluid may be introduced to the barrel during the upstroke of the plunger. In some other embodiments, a gas fraction may also be determined by the amount of gas dissolved in the fluid that may come out of solution during pumping, either in the barrel and/or in the production tubing.

According to the depicted embodiment, the reciprocation of the plunger 42 in the downhole pump may create cyclical pressure waves in the production fluid 2 which may be used to determine one or operating states of the rod pump system. The pressure waves generated by the reciprocation of the plunger 42 may propagate throughout the production fluid which forms a continuous fluidic column from the barrel 40 and up the length of the production tubing 22 to the surface. That is, a pressure wave generated at any location in the production fluid column may propagate throughout the column, such that the pressure wave may be measured at any location in the production fluid column. Accordingly, pressure waves generated by the plunger 42 in the downhole pump travel towards the surface through the production fluid column. Depending on the position of the plunger 42 in its downstroke and upstroke, the pressure of the production fluid at any given location along the production tubing may vary with time. For example, during the downstroke the pressure in the production fluid may decrease slightly or remain constant as new production fluid is introduced into the production tubing. However, as the plunger transitions to the upstroke, the pressure will begin to increase as the plunger lifts the production fluid up the production tubing.

Accordingly, a cyclical pressure wave in the production fluid may be produced by the reciprocating translation of the plunger 42, and such cyclical pressure wave can be measured by one or more pressure sensors disposed in fluid communication with the production fluid of the production fluid column. In embodiments, the pressure sensor(s) can be disposed in fluid communication with the production fluid at or near the surface. Additionally or alternatively, one or more pressure sensors can be located at different locations below the surface along to the production tubing (for example, a few feet below the surface) and/or at the downhole rod pump system.

In embodiments, a processor can interface to the pressure sensor(s) and can be configured to compare characteristics of the cyclical pressure wave measured by the pressured sensor(s) over time to a baseline pressure wave pattern. The processor can further be configured to use the results of such comparison to automatically detect the occurrence of one or more operating states of the downhole pump. The operating states can include normal pump operation, fluid pounding caused by a high gas fraction, pump tagging and other possible operating states, all of which can be used for diagnostics. For example, a significant drop in pressure during the downstroke may indicate a high gas fraction or fluid pound, as no fluid is being added as the plunger 42 moves down the barrel 40. As another example, a spike in pressure amplitude near the bottom of the stroke may indicate pump tagging, as the contact between the plunger and barrel may create a pressure shockwave that passes up the production fluid. Thus, analyzing the pressure waves transmitted through the production fluid column may be used to determine one or more operating states of the rod pump system which may be used for diagnostics of the rod pump system or monitoring the operation of the rod system.

Additionally or alternatively, the processor can be configured to automatically detect the occurrence of one or more operating states of the downhole pump by analyzing the cyclical pressure wave measured by the pressured sensor(s) over time for certain changes in the measured pressure wave (such as certain phase shifts, amplitude changes, mean pressure changes, changes in wave shape and/or other changes) that are indicative of such operating states.

Additionally or alternatively, the processor can be configured to transform the electrical signals output by the pressure sensor(s) over time into a Fourier space or other transformed space, and further constructed and arranged to detect the one or more operating states of the rod pump based at least partly on changes in the transformed electrical signals.

The processor can be further configured to generate and output an indication of the detected operating state(s). In embodiments, the indication can be tones or sounds assigned to the operating states of the downhole pump, colored or flashing lights assigned to the operating states of the downhole pump, a display of text or colors or symbols assigned to the operating states of the downhole pump, or other audio or visual indicators assigned to the operating states of the downhole pump. In other embodiments, the indication can be a status message that carries information that indicates the detected operating state(s). The status message can be communicated via a wired or wireless data communication network to a monitoring station that displays or otherwise alerts a user of the detected operating state(s) of the downhole pump.

In alternate embodiments, one or more additional sensors can be configured in fluid communication with the production fluid that flows through the production tubing and used to measure one or more flow parameters (such as fluid velocity or flow rate) of the production fluid that flows through the production tubing over time. For example, the additional sensor(s) can be a spinner-type flowmeter, torque-type flowmeter, cross-correlation-type flowmeters or other type device that measures a flow parameter of the production fluid. The additional sensor(s) can be located at the surface and/or at different locations below the surface along to the production tubing and/or at the downhole rod pump system. The processor can be configured to automatically detect the occurrence of one or more operating states of the downhole rod pump system based on the flow parameter(s) of the production fluid as measured by the additional sensor(s) over time.

Figure 4:
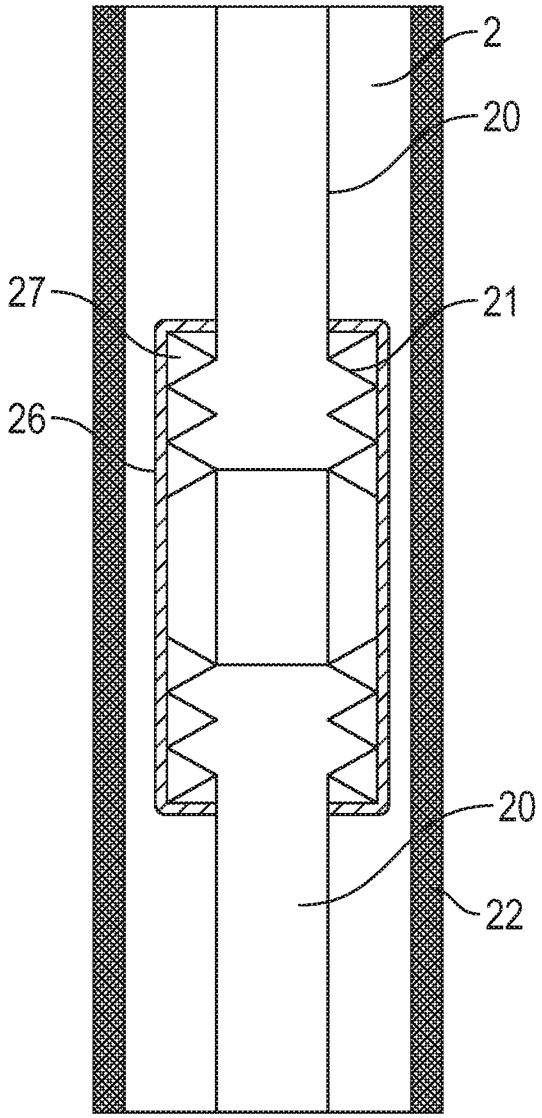
FIG. 4 is a cross sectional view of one embodiment of a rod guide and downhole rod of a rod pump system.

FIG. 4 is a cross sectional view of one embodiment of a rod guide 26 and rod 20 of a rod pump system. As shown in the figure, two downhole rods 20 are joined together by the rod guide. The rod guide includes guide threads 27 on each end which receive rod threads 21 on each end of the downhole rods so that the two rods may be fastened together. According to the present embodiment, the rod guide is larger in diameter than the downhole rods, such that the rod guide keeps the downhole rods out of contact with the production tubing 22. Without wishing to be bound by theory, a gap between the rod guide and production tubing allows production fluid to pass up the production tubing while also centering the rod guide. That is, the production tubing and rod guide may act as a fluid bearing, centering the downhole rods and reducing friction in the rod pump systems as the downhole rods and rod guides remain out of contact with the production tubing. In some embodiments the rod guides may be made of a flexible material, such that the linked downhole rods may be routed around the bends or curves present in many wellbores. In other embodiments, the rod guides may be substantially rigid and may be constructed and arranged as a wear element to prevent rubbing between the production tubing and the rod.

According to the present embodiment, acoustic waves (i.e., pressure waves) generated by the downhole rods 20 and rod guide 26 may be used to determine one or more operating states of the rod pump system. In a normal operating state, the reciprocal motion of the downhole rods and rod guides may have a particular acoustic signature which may be cyclical in nature. For example, the drag of the rods and rod guides from moving through the production fluid 2 may create one or more pressure waves. Changes to these pressure waves may indicate a problem with the downhole rods, rod guides, production tubing 22, or other operating state of the system. For example, in the case of frictional wear between the rod guides and production tubing, there may be a change in amplitude of a pressure wave induced by vibrations caused by the rubbing. The acoustic waves (i.e., pressure waves) generated by the downhole rods 20 and rod guide 26 can propagate through the production fluid of the production fluid column and can be measured over time by a pressure sensor in fluid communication with the production fluid in order to automatically detect one or more operating states of the rod pump system.

In another example, a leak in the production tubing may cause a loss in pressure amplitude, loss in mean pressure, or a phase shift of the pressure waves generated by the downhole rods 20 and rod guide 26 that propagate through the production fluid of the production fluid column. These changes in the pressure wave can be detected over time by a pressure sensor in fluid communication with the production fluid in order to automatically detect the production tubing leak.

Figure 5:
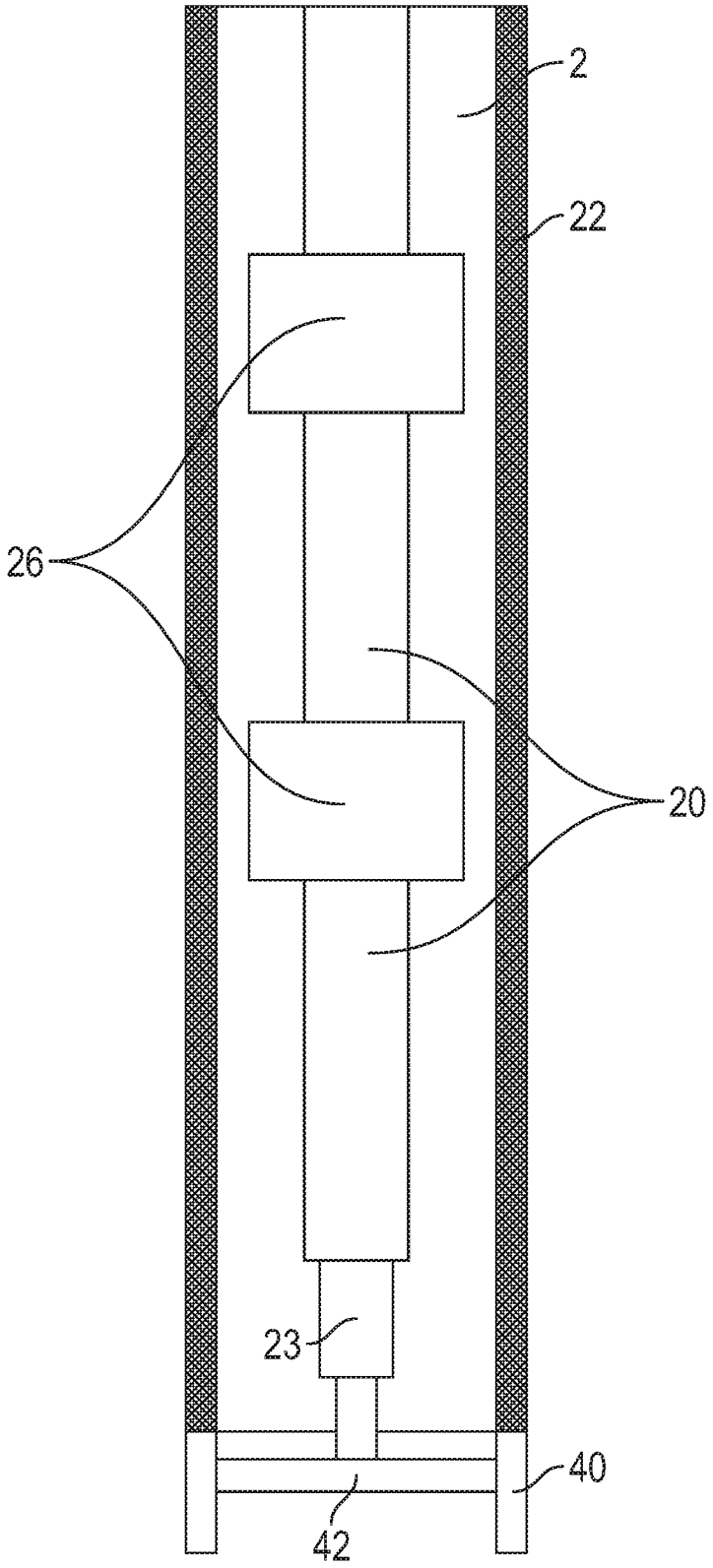
FIG. 5 is a cross sectional view of one embodiment of a downhole rod and a plunger of a rod pump system.

FIG. 5 is a cross sectional view of one embodiment of one or more downhole rods 20 and a plunger 42 of a rod pump system. As shown in the depicted embodiment, the one or more downhole rods are linked by one or more rod guides 26 which are constructed and arranged to link the downhole rods and also act as centralizers to prevent mechanical wear between production tubing 22 and the downhole rods 20. The one or more rods are linked to a plunger 42 which is disposed in barrel 40. As discussed above, the plunger and barrel cooperate to move production fluid 2 up the production tubing. The plunger is reciprocated due to movement of the downhole rods and may be linked to the downhole rods by tapering 23. As shown in FIG. 5, the tapering may be configured as a series of steps, which may have decreasing radii, such that the radius of a step nearer the downhole pump is less than the radius of a more proximal step located nearer the surface. In other embodiments, the tapering may be configured as a series of steps with increasing radii, which may be used in embodiments including a sinker bar configured to increase a bottom rod string weight. Of course, any suitable arrangement of steps with either increasing or decreasing radii may be employed.

According to the depicted embodiment, the plunger 42 and tapering 23 may produce a distinct acoustic signature in the production fluid 2 which may be used to determine one or more operating states of the rod pump system. As shown in FIG. 5, the tapering is constructed and arranged as a series of steps. In some embodiments, the one or more downhole rods 20 may be tapered from the surface, such that the rods gradually become thinner over the length of a wellbore. Of course, any suitable arrangement for the tapering may be employed, including but not limited to a smooth transition (i.e., without sharp corners or changes in direction) or a transition that begins at any point along the length of the one or more downhole rods. During a normal operating state, the tapering and plunger may create a cyclical acoustic signature (e.g., pressure waves caused by fluid drag) with a particular phase, amplitude, and/or mean pressure. If the tapering is damaged, for example by pump tagging causing shock loads, the acoustic signature from the tapering may change in phase, amplitude, and/or mean pressure, indicating a problem with the connection between the downhole rods and plunger. For example, in the case the connection between the plunger and downhole is severed completely, the acoustic signature from the tapering may remain constant, but the acoustic signature from the plunger may change to approximately zero in amplitude. As another example, in the case the seals around the plunger, or the plunger itself, are leaking from corrosion or other general wear, the acoustic waves generated by the plunger may change in amplitude, phase, and/or mean pressure, which may indicate the seals around the plunger should be replaced. In this embodiment, the cyclical acoustic signature of the tapering can propagate through the production fluid of the production fluid column and can be measured over time by a pressure sensor in fluid communication with the production fluid in order to determine one or more operating states of the rod pump system as described above.

Figure 6:
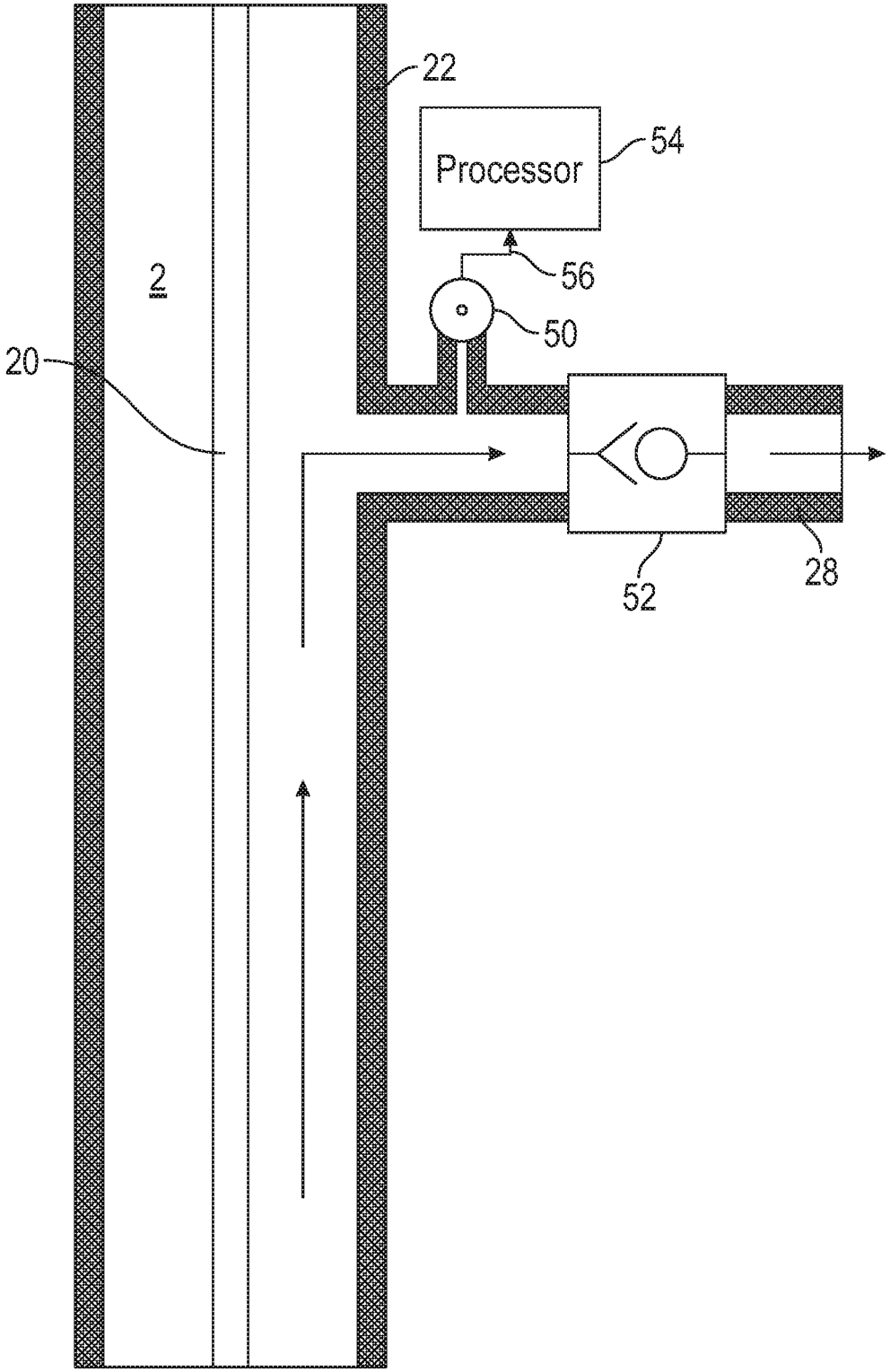
FIG. 6 is a cross sectional view of one embodiment of an outflow tube and a pressure sensor of a rod pump system.

FIG. 6 is a cross sectional view of one embodiment of an outflow tube 28 and a pressure sensor 50 of a rod pump system. As shown in the figure, the pressure sensor 50 is disposed along an outflow tube 28 in fluidic communication with the production tubing 22. As production fluid 2 is lifted up the production tubing 22, it is also moved out of the outflow tube 28 for storage or processing. The production tubing 22 may continue past (i.e., above) the outflow tube 28 and may terminate at the stuffing box (not shown in the figure). The outflow tube 28 may include a backpressure valve 52 which prevents backflow into the production tubing 22 and may be used to set an average pressure inside of the production tubing 22. The pressure sensor 50 may be disposed on the outflow tube 28 and configured to measure the pressure of the production fluid flowing through production tubing 22 (i.e., at a specific location in the production fluid column) over time. The pressure sensor 50 may be placed before (i.e., upstream of) the backpressure valve 52 to reduce the occurrence of interference between the source of the pressure waves and the pressure sensor 50. Accordingly, in the present embodiment, pressure waves generated by any of the rod system components in direct contact or indirect contact with the production fluid may propagate through the production fluid to the pressure sensor 50. Furthermore, a processor 54 interfaces to the pressure sensor 50 via a signal path 56. The processor 54 can be configured to analyze the pressure measurements of the pressured sensor 50 over time to automatically detect one or more operating states of the downhole pump as described herein. The processor can be further configured to generate and output an indication of the detected operating state(s) of the downhole pump as described herein. The processor 54 may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Figure 7:
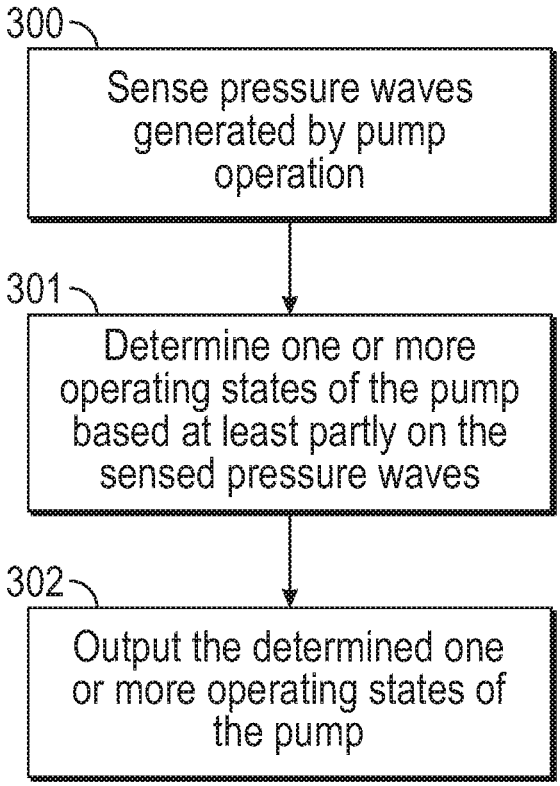
FIG. 7 is a flow chart of one embodiment for analyzing and/or diagnosing a rod pump system.

FIG. 7 is a flow chart of one embodiment for diagnosing a rod pump system. In step 300, pressure waves in production fluid are sensed. In some embodiments, the pressure waves may be sensed by a pressure sensor in fluidic communication with the production fluid as described above. In step 301, one or more operating states of the pump are determined based at least partly on the sensed pressure waves. In some embodiments, the one or more states may be determined based on an amplitude, mean pressure, and/or phase shift of the pressure waves or any other appropriate parameter of the sensed pressure wave. Additionally, the one or more states may be determined based on a model of the rod pump system and expected pressure wave. In step 302, the one or more operating states of the pump may be output to a user for review.

Figure 8:
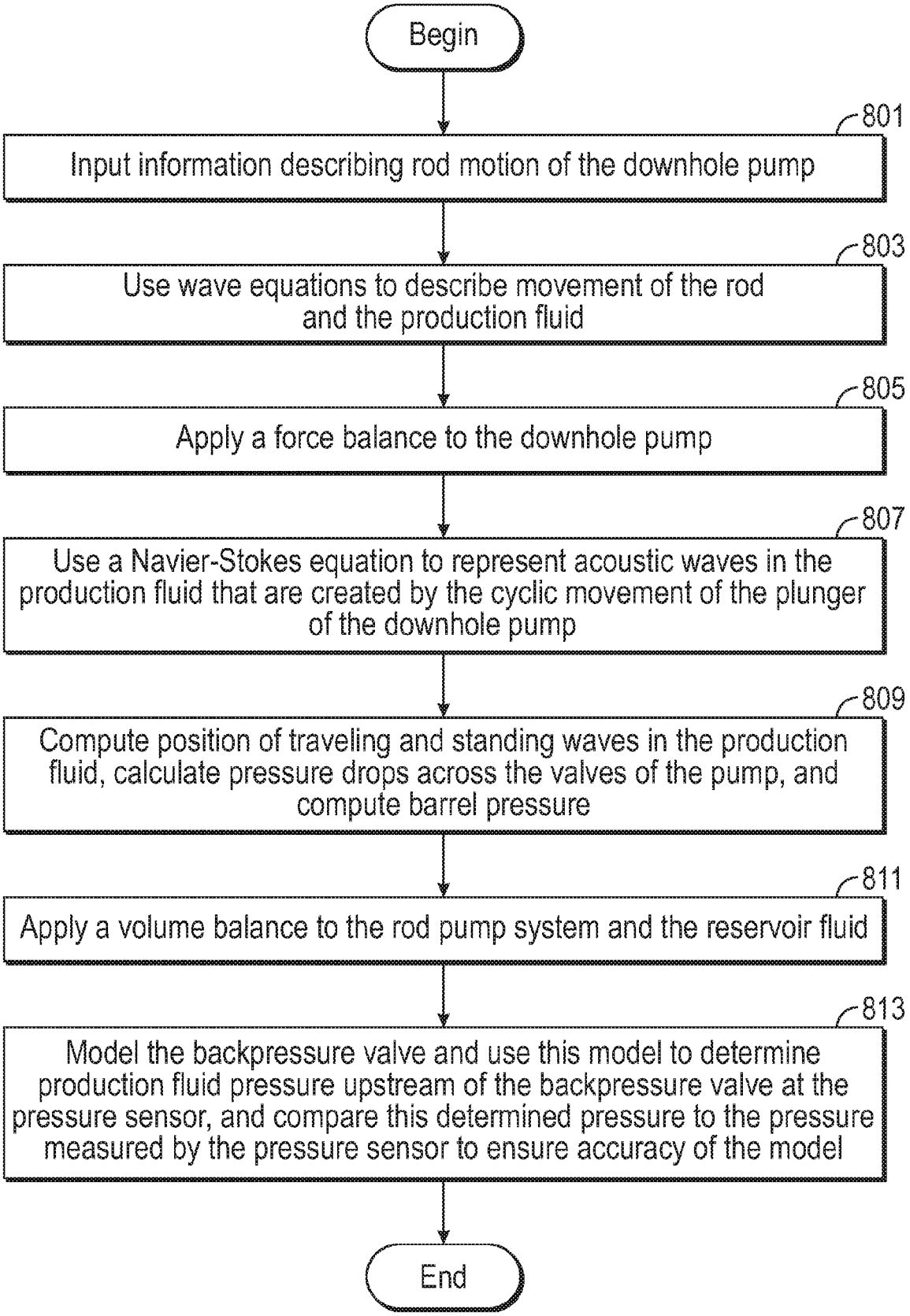
FIG. 8 is a flow chart of one embodiment for modeling the operation of a rod pump system and the production fluid lifted by such operation.

In some embodiments, the operations of the processor 504 that analyze the pressure measurements of the pressure sensor 50 over time to automatically detect one or more operating states of the downhole pump can be based on a series of inputs and steps to a model as shown in FIG. 8. In embodiments, the model can be configured to account for various viscous damping forces that affect the flow of the reservoir fluid into the pump and the flow of the production fluid through the production tubing to the surface. For example, such viscous damping forces can be based on the speed of the rod pump, composition of the reservoir fluid/production fluid, and other factors.

In step 801, a polished rod motion may be input into the model. The polished rod motion may be known either from a direct measurement or converted from a known or measured motor RPM, the gearbox gearing, and/or pumping unit kinematics.

In step 803, two wave equations may be employed to link the movement of the rod and the fluid. Each equation also includes damping terms. In order to solve the two wave equations, two boundary conditions may be used for each. In some embodiments, the boundary conditions may be an uppermost downhole rod motion is assumed to be equivalent to the polished rod motion and a surface pressure of production fluid is assumed to be equivalent to the pressure at a backpressure valve. Various other type of surface boundaries can be used, including, but not limited to, a fixed pressure, a fixed fluid velocity, a non-reflecting boundary, a partially reflective boundary with or without damping, and any superposition of the previous boundaries.

In step 805, a force balance may be applied to a downhole pump system. That is, a pressure (i.e., force) above the downhole pump may be the superposition of the hydrostatic pressure and the acoustic pressure, while the pressure below the pump is a barrel pressure. Various viscous damping forces based on the speed of the pump and composition of the reservoir fluid/production fluid may be accounted for, including those caused by rod stretch and fluid leakage around a plunger of the downhole pump. The barrel pressure may be calculated incorporating the gas fraction.

In step 807, the plunger may create acoustic waves in the fluid that may be recognized using a simplified Navier-Stokes equation. During this step, the flow leakage past the plunger may also be evaluated.

In step 809, the position of the traveling and standing valves may be computed based on the pressures above and below the downhole pump computed in steps 805 and 807. Based on the state of the valves (i.e., open or closed), the pressure drop across each may be computed. Barrel pressure may be recomputed based on the valve position, the plunger position and velocity, a plunger minimum set position, and the gas fraction.

In step 811, a volume balance may be applied to the rod pump system and to reservoir fluid (i.e., fluid in the cavity between a casing and production tubing). The reservoir fluid level may be consistently monitored. In some cases, if the reservoir fluid level is equal to the pump inlet level gas will be sucked in the downhole pump and gas fraction will increase. Additionally, the reservoir fluid level influences when the standing valve opens. The reservoir flow into the casing may be calculated from advanced reservoir models or be assumed to be a simple flow that depends only on the casing pressure at the perforations.

In step 813, the production fluid may be linked to a surface flow line via a backpressure valve. The operation of the backpressure valve may be modeled, and the results of the backpressure valve model used to determine the production fluid pressure upstream of the backpressure valve at the pressure sensor. This fluid pressure determined by the model may be compared to the pressure measured by the pressure sensor to ensure the accuracy of the model of steps 801-813.

In some embodiments, equations may be used to model various operational aspects of the rod pump system, such as baseline pressure wave patterns in the production fluid lifted by the operation of the rod pump system which occur during normal operation of the system. In one such embodiment, movement of a downhole pump, traveling and standing valves, and rod tapering (i.e., changes in cross section) create distinct pressure waves. Those waves propagate in the tubing according to the following equation (1):

$$\frac{\partial^2 P}{\partial t^2} = c^2 \frac{\partial^2 P}{\partial x^2} + \alpha_p \frac{\partial P}{\partial t} + \beta_p \frac{\partial (V_{rod} - V_{fluid})^2}{\partial x} + \gamma_p \frac{\partial^3 P}{\partial t \partial x^2} \tag{1}$$

Where c is the velocity of the sound waves in the fluid, $\alpha_p$ is a wall friction constant and represents a damping or stabilizing effect, $\gamma_p$ depends on fluid viscosity and is significantly reduced for production fluids with high water content, and $\beta_p$ is a non-linear parameter that controls the non-linear coupling effect of the distributed rod motion and production fluid motion. For clarity, only P (t) (i.e., production fluid pressure) is in the equation above. In many cases it may be appropriate to change P (t) to P(x, t) (i.e., the pressure at any position along the tubing (coordinate x) and at any time t) for more accurate results of the model. Similarly, $V_{rod}$ (t) and $V_{fluid}$ (t), may also be changed to depend on position. Without wishing to be bound by theory, the pressure is the same radially (i.e., the pressure is the same in the middle of production tubing or on the outside of the production tubing). Additionally, the pressure changes when there is a tapering of the rod (i.e., the rod gets bigger as you get closer to the surface). This equation may be employed to link the pressure in the production fluid to the motion of the rod pump system, such that one or more operating states may be determined.

In some embodiments, the rod pump system may be modeled using a force balance equation. In one such embodiment, the equation may be Newton's $2^{nd}$ law (i.e., F=ma) which is used to create a force balance in the pressures above and below a downhole pump. The pressure above the downhole pump is calculated using the fluid pressure equation, while the pressure below the downhole pump is calculated by knowing the pump dimension and gas fraction. Thus, with the combination of pressures above and below, and accounting for the mass of the various rod pump system components like the plunger and one or more downhole rods, a force balance can be determined which indicates the position and motion of the rod pump system. The resulting equation (2) is:

$$m_{pump} \frac{\partial^2 \xi}{\partial t^2} = -EA_{rod} \frac{\partial \xi}{\partial x} + A_{plunger}(P_{above} - P_{below}) + F_{visc} \tag{2}$$

where $m_{pump}$ is the mass of the downhole pump, $A_{rod}$ is the cross-sectional area of the rod that varies along the length of the downhole rod, $A_{plunger}$ is the surface area of the plunger exposed to pressure, and $F_{visc}$ are additional forces from gravity on the rod pump system components ξ is the rod relative position in the wellbore. $P_{above}$ is the pressure above the downhole pump and $P_{below}$ is the pressure below the downhole pump as described above. According to the present embodiment, pressure waves in the production fluid may be used to determine one or more operating states of the rod pump system, including information regarding the position and velocity of the downhole pump.

In some embodiments, equations may be used to model the waves in the one or more downhole rods and rod guides. In one such embodiment, waves propagate through the one or more downhole rods and rod guides which produces distinct acoustic signals. Such distinct acoustic signals can be detected and processed to determine one or more operating states of the rod pump system, including information regarding the downhole rods and rod guides.

In other embodiments, equations may be used to model the fluid velocity of the production fluid that flows through the production tubing based on the operation of the rod pump system. For example, the fluid velocity of the production fluid that flows through the production tubing can be modeled according to the following equation (3):

$$\frac{\partial^2 \xi}{\partial t^2} = c^2 \frac{\partial^2 \xi}{\partial x^2} + \alpha \frac{\partial \xi}{\partial t} + \beta \left( \frac{\partial \xi}{\partial t} - V_{fluid} \right)^2 + g \tag{3}$$

where ξ is the rod relative position, c is the velocity of the sound waves in the fluid, α is a wall friction constant and represents a damping or stabilizing effect, β is a non-linear parameter that controls the non-linear coupling effect of the downhole rod motion and production fluid motion, $V_{fluid}$ is the fluid velocity, and g is the gravity constant. In some cases, it may be desirable to make ξ dependent on both position x and time t. Similarly, it may be desirable to make $V_{fluid}$ depend on time as well. According to this embodiment, the velocity of the fluid is directly coupled to the velocity of the one or more downhole rods and rod guides. Information of the location and geometries of the rod guides can be part of the model and improve the diagnostics. In some embodiments, the damping effect may scale as the square of the velocities as written in the equation above. Of course, the power coefficient may be any suitable value, and may vary based on the velocities of various system components, fluid velocity, fluid composition, and any other appropriate parameter of the rod pump system. Accordingly, the model can be used to predict the fluid velocity of the production fluid over time. The fluid velocity of the production fluid can be measured by a flow meter over time and compared to the fluid velocity predicted by the model over time. Differences between the measured fluid velocity and the predicted fluid velocity can be used to determine one or more operating states of the rod pump system.

The above-described embodiments of the technology described herein can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Also, a system may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a system may receive input information through speech recognition or in other audible format.

Such computing devices may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the embodiments described herein may be embodied as a computer readable storage medium (or multiple computer readable media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computers or other processors to implement various aspects of the present disclosure as discussed above. As used herein, the term "computer-readable storage medium" encompasses only a non-transitory computer-readable medium that can be considered to be a manufacture (i.e., article of manufacture) or a machine. Alternatively or additionally, the disclosure may be embodied as a computer readable medium other than a computer-readable storage medium, such as a propagating signal.

The terms "program" or "software" are used herein in a generic sense to refer to any type of computer code or set of computer-executable instructions that can be employed to program a computer or other processor to implement various aspects of the present disclosure as discussed above. Additionally, it should be appreciated that according to one aspect of this embodiment, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the embodiments described herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Further, some actions are described as taken by a "user." It should be appreciated that a "user" need not be a single individual, and that in some embodiments, actions attributable to a "user" may be performed by a team of individuals and/or an individual in combination with computer-assisted tools or other mechanisms.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A method of diagnosing or monitoring operation of a rod pump system:

the rod pump system having:

a downhole pump that comprises: a pump plunger, a traveling valve, a standing valve, surface equipment that includes a polished rod, an outflow tube that includes a backpressure valve, a pressure sensor, and a surface flow line;

the method comprising:

sensing pressure waves generated from movement of the pump plunger of the rod pump system; and detecting one or more operating states of the rod pump system based at least partly on the sensed pressure waves, wherein the operating state is detected using a model, wherein use of the model comprises, inputting a polished rod motion;

using a two wave equation to link movement of the polished rod motion with movement of a production fluid; applying a force balance, wherein a pressure above the downhole pump is a superposition of a hydrostatic pressure and an acoustic pressure of the production fluid, and pressure below the downhole pump is a barrel pressure; wherein the barrel pressure comprises incorporation of a gas fraction; evaluating a flow leakage past the pump plunger of the downhole pump; calculating a position of the traveling and standing valves based on the pressure above and below the downhole pump; calculating the pressure drop across the traveling and the standing valves; performing a volume balance to the rod pump system and a reservoir fluid; and linking the production fluid to the surface flow line via the backpressure valve, and creating a backpressure valve model, and using the backpressure valve model to determine the pressure of the production fluid upstream of the backpressure valve, and comparing the production fluid pressure determined by the backpressure valve model to a pressure sensor to ensure accuracy.

2. The method of claim 1, wherein the one or more operating states of the rod pump system comprise at least one of normal pump operation, gas lock, pump tagging, unanchored tubing, distorted barrel, riding valve leakage, standing valve leakage, gas compression, flumping, barrel leakage, barrel contact friction, fluid pounding, and gas interference.

3. The method of claim 1, further comprising outputting an indication of the one or more operating states of the rod pump system.

4. The method of claim 1, further comprising determining at least one of a phase, an amplitude, a phase change, an amplitude change, and a mean pressure change in the sensed pressure waves, wherein detecting the one or more operating states of the rod pump system is based at least partly on the at least one of the phase, the amplitude, the phase change, the amplitude change, and the mean pressure change in the sensed pressure waves.

5. The method of claim 1, further comprising processing electrical signals representing the sensed pressure waves by transforming the electrical signals into a Fourier space or other transformed space, wherein detecting the one or more operating states of the rod pump system is based at least partly on changes in the transformed electrical signals.

6. The method of claim 1, wherein the rod pump system is configured to lift the production fluid that flows through production tubing and the pressure waves propagate in the production fluid that flows through the production tubing over time during operation of the rod pump system.

7. The method of claim 6, further comprising measuring additional flow parameters of the production fluid that flows through the production tubing over time during operation of the rod pump system, wherein detecting one or more operating states of the rod pump system is based at least partly on the measured additional flow parameters.

8. The method of claim 6, wherein the pressure waves are sensed at a plurality of different locations in tubing that carries the flow of the production fluid.

9. The method of claim 8, wherein the plurality of different locations includes a location on the surface and/or a location a few feet below the surface.

10. A system for diagnosing or monitoring operation of a rod pump system, disposed in a reservoir, having a polished rod, an outflow tube that includes a backpressure valve, a pressure sensor, a surface flow line and a downhole pump that includes a pump plunger, a traveling valve and a standing valve, where the downhole rod pump system is configured to lift production fluid from a production tubing comprising:

at least one pressure sensor constructed and arranged to sense pressure waves generated from movement of the pump plunger of the rod pump system; and a processor constructed and arranged to detect one or more operating states of the rod pump system based at least partly on the sensed pressure waves wherein the processor is configured to, detect an operating state using a model, wherein use of the model comprises, receiving input on a polished rod motion; using a two wave equation to link movement of the polished rod motion with movement of a production fluid; applying a force balance, wherein pressure above the downhole pump is a superposition of a hydrostatic pressure and an acoustic pressure of the production fluid, and pressure below the downhole pump is a barrel pressure; wherein the barrel pressure comprises incorporation of a gas fraction;

evaluating a flow leakage past the pump plunger; calculating a position of the traveling and standing valves based on the pressure above and below the downhole pump; calculate the pressure drop across the traveling and the standing valves; performing a volume balance to the rod pump system and a reservoir fluid, wherein the reservoir fluid is fluid in a cavity between a casing and a production tubing downhole; and linking the production fluid to the surface flow line via the backpressure valve, and create a backpressure valve model, and use the backpressure valve model to determine the pressure of the production fluid upstream of the backpressure valve, and compare the production fluid pressure determined by the backpressure valve model to a pressure sensor to ensure accuracy.

11. The system of claim 10, wherein the one or more operating states of the rod pump system comprise at least one of normal pump operation, gas lock, pump tagging, unanchored tubing, distorted barrel, riding valve leakage, standing valve leakage, gas compression, flumping, barrel leakage, barrel contact friction, fluid pounding, and gas interference.

12. The system of claim 10, wherein the processor is further constructed and arranged to output an indication of the one or more operating states of the rod pump system.

13. The system of claim 10, wherein the processor is further constructed and arranged to determine at least one of a phase, an amplitude, a phase change, an amplitude change, and a mean pressure change in the pressure waves, and wherein the processor is further constructed and arranged to determine the one or more operating states of the rod pump system based at least partly on the at least one of the phase, the amplitude, the phase change, the amplitude change, and the mean pressure change.

14. The system of claim 10, wherein the at least one pressure sensor outputs electrical signals representing the sensed pressure waves, wherein the processor is further constructed and arranged to process the electrical signals output by the at least one pressure sensor by transforming the electrical signals into a Fourier space or other transformed space, and wherein the processor is further constructed and arranged to detect the one or more operating states of the rod pump system based at least partly on changes in the transformed electrical signals.

15. The system of claim 10, wherein the rod pump system is configured to lift production fluid that flows through production tubing and the pressure waves propagate in the production fluid that flows through the production tubing over time during operation of the rod pump.

16. The system of claim 15, further comprising at least one additional sensor in fluid communication with the production fluid, wherein the at least one additional sensor is configured and arranged to measure flow parameters of the production fluid that flows through the production tubing over time during operation of the rod pump system, and wherein the processor is further constructed and arranged to detect one or more operating states of the rod pump system based at least partly on the measured flow parameters.

17. The system of claim 15, wherein the at least one pressure sensor comprises a plurality of pressure sensors disposed at different locations in tubing that carries the flow of the production fluid.

18. The system of claim 17, wherein the plurality of different locations includes a location on the surface and/or possibly a location a few feet below the surface.

19. A system for use with a downhole rod pump system having a polished rod, an outflow tube that includes a backpressure valve, a pressure sensor, a surface flow line, and a downhole pump that includes:

a pump plunger, a traveling valve, and a standing valve, where the downhole rod pump system is configured to lift production fluid that flows through production tubing, the system comprising:

at least one pressure sensor constructed and arranged to sense pressure waves generated from movement of the pump plunger of the downhole rod pump system, wherein the pressure waves propagate in the production fluid that flows through the production tubing; and a processor constructed and arranged to detect one or more operating states of the downhole rod pump system based at least partly on the sensed pressure waves wherein the processor is configured to detect one or more operating states using a model, wherein use of the model comprises, receiving input on a polished rod motion; use a two wave equation to link movement of the polished rod motion with movement of the production fluid; applying a force balance, wherein pressure above the downhole pump is a superposition of a hydrostatic pressure and an acoustic pressure of the production fluid, and pressure below the downhole pump is a barrel pressure;

wherein the barrel pressure comprises incorporation of a gas fraction; evaluating a flow leakage past the pump plunger;

calculating a position of the traveling and standing valves based on the pressure above and below the downhole pump; calculating the pressure drop across the traveling and the standing valves; performing a volume balance to the rod pump system and a reservoir fluid; and linking the production fluid to the surface flow line via the backpressure valve, and creating a backpressure valve model, and use backpressure valve model to determine the pressure of the production fluid upstream of the backpressure valve, and comparing the production fluid pressure determined by the backpressure valve model to a pressure sensor to ensure accuracy.

20. The system of claim 19, wherein the one or more operating states of the downhole rod pump system comprise at least one of normal pump operation, gas lock, pump tagging, unanchored tubing, distorted barrel, riding valve leakage, standing valve leakage, gas compression, flumping, barrel leakage, barrel contact friction, fluid pounding, and gas interference.

21. The system of claim 19, wherein the processor is further constructed and arranged to output an indication of the one or more operating states of the downhole rod pump system.

22. The system of claim 19, wherein the processor is further constructed and arranged to determine at least one of a phase, an amplitude, a phase change, an amplitude change, and a mean pressure change in the pressure waves, and wherein the processor is further constructed and arranged to determine the one or more operating states of the downhole rod pump system based at least partly on the at least one of the phase, the amplitude, the phase change, the amplitude change, and the mean pressure change.

23. The system of claim 19, wherein the at least one pressure sensor outputs electrical signals representing the sensed pressure waves, wherein the processor is further constructed and arranged to process the electrical signals output by the at least one pressure sensor by transforming the electrical signals into a Fourier space or other transformed space, and wherein the processor is further constructed and arranged to detect the one or more operating states of the rod pump system based at least partly on changes in the transformed electrical signals.

24. The system of claim 19, wherein the at least one pressure sensor is in fluid communication with the production fluid and is configured to measure pressure of the production fluid that flows through the production tubing over time during operation of the downhole rod pump system.

25. The system of claim 24, further comprising at least one additional sensor in fluid communication with the production fluid, wherein the at least one additional sensor is configured and arranged to measure flow parameters of the production fluid that flows through the production tubing over time during operation of the rod pump system, and wherein the processor is further constructed and arranged to detect one or more operating states of the rod pump system based at least partly on the measured flow parameters.

26. The system of claim 19, wherein the at least one pressure sensor comprises a plurality of pressure sensors disposed at different locations in tubing that carries the flow of the production fluid.

27. The system of claim 26, wherein the plurality of different locations includes a location on the surface and/or possibly a location a few feet below the surface.

28. The system of claim 19, wherein the processor is located at the surface.

* * * * *